United States Patent [19]

Lempio

[11] Patent Number: 4,687,204

[45] Date of Patent: Aug. 18, 1987

[54] GOLF CLUB INCLUDING DETACHABLE GOLF BALL RETRIEVER

[76] Inventor: Paul S. Lempio, 11 Fay Dr., Kentfield, Calif. 94904

[21] Appl. No.: 777,079

[22] Filed: Sep. 17, 1985

[51] Int. Cl.[4] ..... A63B 53/00; A47F 13/06

[52] U.S. Cl. ..... 273/162 E; 294/19.2

[58] Field of Search ..... 273/162 E, 162 R, 162 A, 273/162 B, 162 C, 162 D, 162 F; 294/19.2

[56] References Cited

U.S. PATENT DOCUMENTS

| | | | |
|---|---|---|---|
| 1,658,145 | 2/1928 | Uyel | 273/162 E |
| 1,674,294 | 6/1928 | O'Rourke | 273/162 E |
| 1,722,519 | 7/1929 | Du Chene | 273/162 E |
| 2,802,687 | 8/1957 | Du Chene | 273/162 E |
| 2,935,323 | 5/1960 | Cummings | 294/19.2 |
| 3,743,338 | 7/1973 | Seeger | 294/19.2 |

FOREIGN PATENT DOCUMENTS

| | | | |
|---|---|---|---|
| 216731 | 6/1924 | United Kingdom | 294/19.2 |

*Primary Examiner*—George J. Marlo

*Attorney, Agent, or Firm*—Phillips, Moore, Lempio & Finley

[57] ABSTRACT

A golf ball retriever is adapted for attachment to the butt end of a golf club to form an extension thereof. The retriever includes a scoop adapted to retrieve and retain a golf ball therein and a bent wire-like attachment secured to the scoop and insertable through a standard hole formed axially through the golf club grip for frictionally attaching the retriever to the golf club.

9 Claims, 2 Drawing Figures

GOLF CLUB INCLUDING DETACHABLE GOLF BALL RETRIEVER

TECHNICAL FIELD

This invention relates to a golf ball retriever and more particularly to a retriever adapted to be releasably attached to the butt end of a golf club.

BACKGROUND ART

Conventional golf ball retrievers normally comprise an extensable handle having a scoop attached to the end thereof for retrieving and retaining a golf ball therein. The retriever is collapsible to be normally placed in a golf bag along with the golf clubs. Such retrievers are expensive to manufacture, somewhat cumbersome to use and take up valuable space in the golf bag.

Applicant's experience indicates that most golf balls retrieved from a water hazard require a retriever no longer than approximately three feet for golf ball retrieval purposes. Other lost balls normally cannot be seen or are so far out in the hazard that retrieval is impossible.

DISCLOSURE OF INVENTION

This invention is directed to an improved and economical golf ball retriever that can be attached to a golf club expeditiously to form an extension thereof for golf ball retrieving purposes.

The golf ball retriever of this invention comprises scoop means for retrieving and retaining at least one golf ball therein and attachment means for releasably attaching the scoop means to a butt end of a golf club.

In the preferred retriever embodiment, the attachment means comprises a bent wire-like extension inserted through a hole formed axially through the butt end of a grip secured on a hollow shaft of the golf club. The extension is held in place by its frictional engagement within the shaft.

Applicant has built and tested an experimental prototype of his golf retriever, substantially as shown in the drawing, with excellent results.

BRIEF DESCRIPTION OF THE DRAWING

Other advantages and objects of this invention will become apparent from the following description accompanying drawing wherein.

BEST MODE OF CARRYING OUT THE INVENTION

Figure 1:
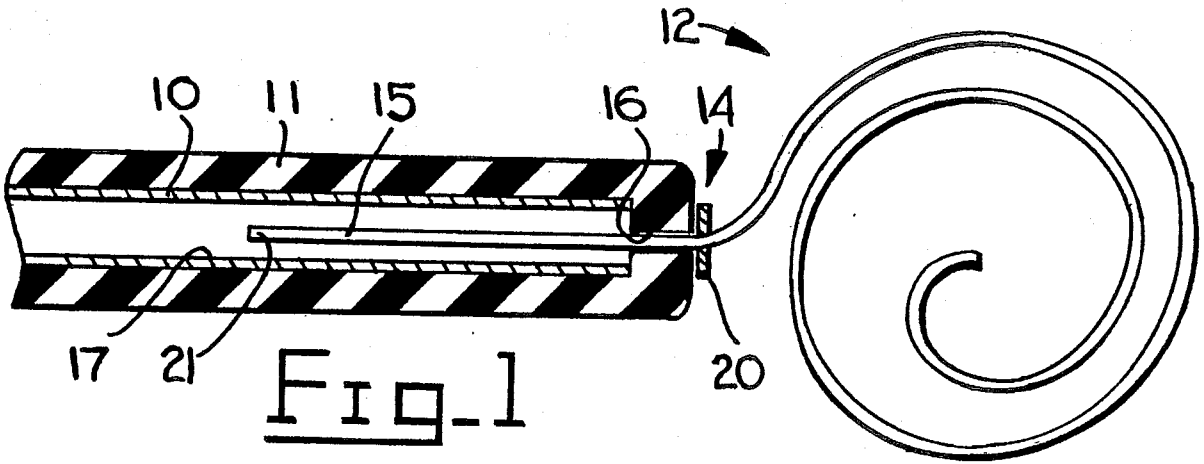
FIG. 1 is a top plan sectional view illustrating the butt end of a golf club having a golf ball retriever embodiment of this invention attached thereto.

FIG. 1 partially illustrates a golf club comprising a standard hollow shaft 10 having a grip 11 secured on an end thereof. The shaft is rigid and is normally composed of stainless steel, aluminum, a composite graphite material, or the like. Grip 11 is composed of a standard grip material, such as a cloth-reinforced elastomeric (e.g., rubber) material as is well known in the golf arts.

This invention is directed to a golf ball retriever 12 adapted for releasable attachment to the butt end of the golf club. The retriever may comprise a scoop 13 suitably configured to retrieve and retain at least one golf ball therein. In the embodiment illustrated, the scoop is generally formed as a conical helical spring of circular cross-section, fabricated from a single piece of wire spring steel. Alternatively, the wire could have a rectangular cross-section.

Retriever 12 further comprises attachment means 14 for releasably attaching scoop 13 to the golf club by inserting a wire extension 15 thereof through a standard hole 16 pre-formed axially and centrally through the butt end of grip 11. Extension 15 is formed integrally with scoop 13 and from the same piece of wire forming it. The wire may be formed from a standard spring steel material, such as SAE 1060, 1074 or 1095, having an outside diameter preferably selected from the approximate range of from 0.0625 to 0.125 in.

Figure 2:
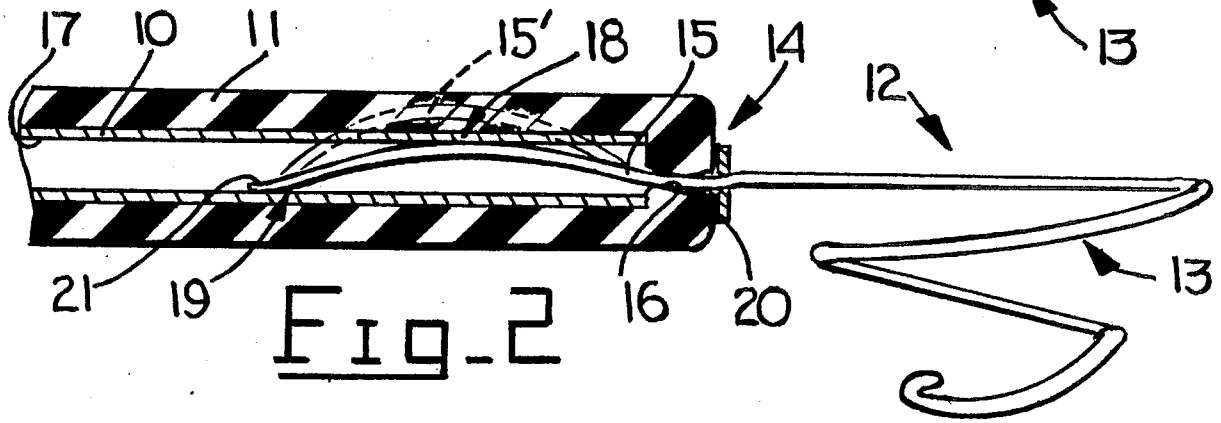
FIG. 2 is a side elevational view thereof.

It is preferred that the diameter of the wire be slightly greater than the normal unstretched diameter of standard hole 16 (approximating 0.093 in.) so that the portion of wire extension 15 surrounded by elastomeric portions of grip 11, defining hole 16, will aid in frictionally holding the retriever in place. As shown in FIG. 2, when extension 15 is inserted through holes 16 and into the confines of a bore 17 defined in hollow shaft 10, the curved extension will be compressed from its relaxed phantom line condition 15' to its flexed solid line position 15. Thus, an intermediate portion of the extension will frictionally engage an inner wall of shaft 10 at a bearing contact 18 whereas an end of the extension will frictionally engage in opposite sidewall portion of the shaft at a bearing contact 19.

The tensile, torsional, hardness and related physical properties of the spring steel wire composing extension 15 and its configuration are suitably precalculated to provide the desired flexing and binding effect of the extension to frictionally hold it in place, but yet permit its relaxation (spring-back) and removal through hole 16. Thus, the frictional engagement of the extension with the shaft at longitudinally spaced bearing contacts 18 and 19 and the frictional holding of the extension by the elastomeric grip at hole 16 (which deforms, as shown in FIG. 2) will firmly hold the retriever in place on the shaft of the club for golf ball retrieving purposes.

In most retrieval applications, the player will select his driver for attachment of retriever 12 thereto since the driver has a longer shaft than the other clubs in his bag. A standard washer 20 can be soldered or otherwise suitably secured to extension 15 to provide stop means delimiting the extent of insertion of the extension into the shaft. The stop means will thus precisely position bearing points 18 and 19 within the shaft.

If so desired, an end 21 of the extension may be slightly curved (reverse bent) and flattened to increase the frictional bearing surface thereof and to prevent scarring of the inner wall of shaft 10. In addition, a thin plastic coating may be applied to the retriever by a conventional dipping or spraying process. Such coating will prevent rusting or erosion of the wire retriever and will also deter scarring of the inner wall of shaft 10.

A standard shaft 10 has an outside diameter closely approximating 0.5 in. and a wall thickness of 0.062 in. or less. A standard grip 11 has the following approximate dimensions: Length of 10.25 in.; tapered-down outside diameter of from 1.0 into 0.625 in; inside diameter of 0.5 in.; and a tapered down wall thickness of from 0.25 in. (including the wall thickness at hole 16) to 0.062 in.; and hole 16 of 0.093 in.

The above-referenced experimental prototype generally conformed to the retriever shown in FIGS. 1 and 2. The retriever was used with the above-described type of standard club-grip and successfully functioned to recover numerous golf ball hit astray into water hazards by applicant. Dimensional parameters of the prototypes were approximately as follows: Overall length (6.0 in.); length of scoop 13 (3.0 in.); length of extension 15 (3.0 in.); diameter of largest upper coil of scoop 13 (3.0 in.); vertical height of scoop 13 as shown in FIG. 2 (1.5 in.); number of coils (2); diameter of spring steel wire composing retriever 12 (0.093 in.); and curvature of relaxed arcuate extension 15 as depicted at 15' in FIG. 2 (about 1.75 in. average radius).

I claim:

1. A golf club including a golf ball retriever attached to said golf club through a hole formed axially through the butt end of a grip secured on an end of a hollow shaft thereof, said hole being smaller in diameter than the internal diameter of said shaft, said retriever comprising scoop means for retrieving and retaining at least one golf ball therein, and attachment means insertable through said hole for releasably attaching said scoop means to said golf club by insertion through said hole and frictional engagement with said hollow shaft.

2. The golf ball retriever of claim 1 wherein said scoop means generally comprises a conical helical spring forming a scoop.

3. The golf ball retriever of claim 2 wherein said attachment means comprises a wire extension formed integrally with said helical spring from a common wire.

4. The golf ball retriever of claim 3 wherein said wire extension forms an arcuate configuration defining bearing surface means thereon for frictionally engaging internal sidewalls of said shaft in longitudinally spaced relationship therein.

5. The golf ball retriever of claim 4 further comprising stop means secured on said wire extension for delimiting the extent of insertion of said wire extension into said shaft.

6. The golf ball retriever of claim 3 wherein the wire composing said scoop means and said attachment means is coated with a plastic material.

7. The golf ball retriever of claim 3 wherein the common wire forming said scoop and said extension is composed of spring steel having a diameter selected from the approximate range of from 0.0625 to 0.125 in.

8. The golf club retriever of claim 4 wherein said wire extension has an average radius approximating about 1.75 in.

9. A golf club in combination with golf ball retriever for attachment to a butt end thereof, said golf club having a hollow shaft, a grip secured on an end of said shaft and a hole smaller in diameter than the internal diameter of said hollow shaft formed axially through a butt end of said grip, said retriever comprising scoop means for retrieving and retaining at least one golf ball therein, and attachment means for releasably attaching said scoop means to said golf club, including a wire-like curved and flexible extension means insertable through said hole for frictionally engaging inner wall portions of said hollow shaft when said extension means is inserted through said hole.

* * * * *